United States Patent [19]

Severson

[11] 4,017,080

[45] Apr. 12, 1977

[54] ARITHMETIC BOARD GAME

[76] Inventor: Richard W. Severson, 2644 Boetcher Road, Waukesha, Wis. 53186

[22] Filed: Sept. 17, 1975

[21] Appl. No.: 614,067

[52] U.S. Cl. ..... 273/135 R; 35/31 F

[51] Int. Cl.[2] ..... A63F 9/18

[58] Field of Search ... 273/135 R, 135 AD, 135 AC, 273/130 R, 130 A, 135 B, 136 E; 35/31 R, 31 F, 31 G, 70

[56] References Cited

UNITED STATES PATENTS

| | | | |
|---|---|---|---|
| 1,402,807 | 1/1922 | Tegtmeyer et al. | 273/135 B |
| 2,320,832 | 6/1943 | Schoeberg et al. | 273/130 R |
| 2,645,038 | 7/1953 | Merrill | 35/31 F |
| 3,314,168 | 4/1967 | Heckman | 35/70 |
| 3,429,572 | 2/1969 | Mars | 273/136 E |
| 3,503,612 | 3/1970 | Singer | 273/130 E |
| 3,524,648 | 8/1970 | Nilan | 273/130 A |
| 3,677,549 | 7/1972 | Moscovich | 273/135 R |
| 3,844,568 | 10/1974 | Armstrong | 273/135 R |
| 3,904,207 | 9/1975 | Gold | 273/135 R |

FOREIGN PATENTS OR APPLICATIONS

| | | | |
|---|---|---|---|
| 165,863 | 12/1933 | Switzerland | 273/130 R |

*Primary Examiner*—Richard C. Pinkham
*Assistant Examiner*—Harry G. Strappello

[57] ABSTRACT

A competitive board game in which two playing boards are used and a set of 117 tiles for placement upon the playing boards, the playing boards having spaces where the tiles are to be placed, some of the tiles having arithmetic addition, subtraction, multiplication and division symbols while other of the tiles have the numerical digits, the game using arithmetic so to be played.

1 Claim, 4 Drawing Figures

Fig. 1
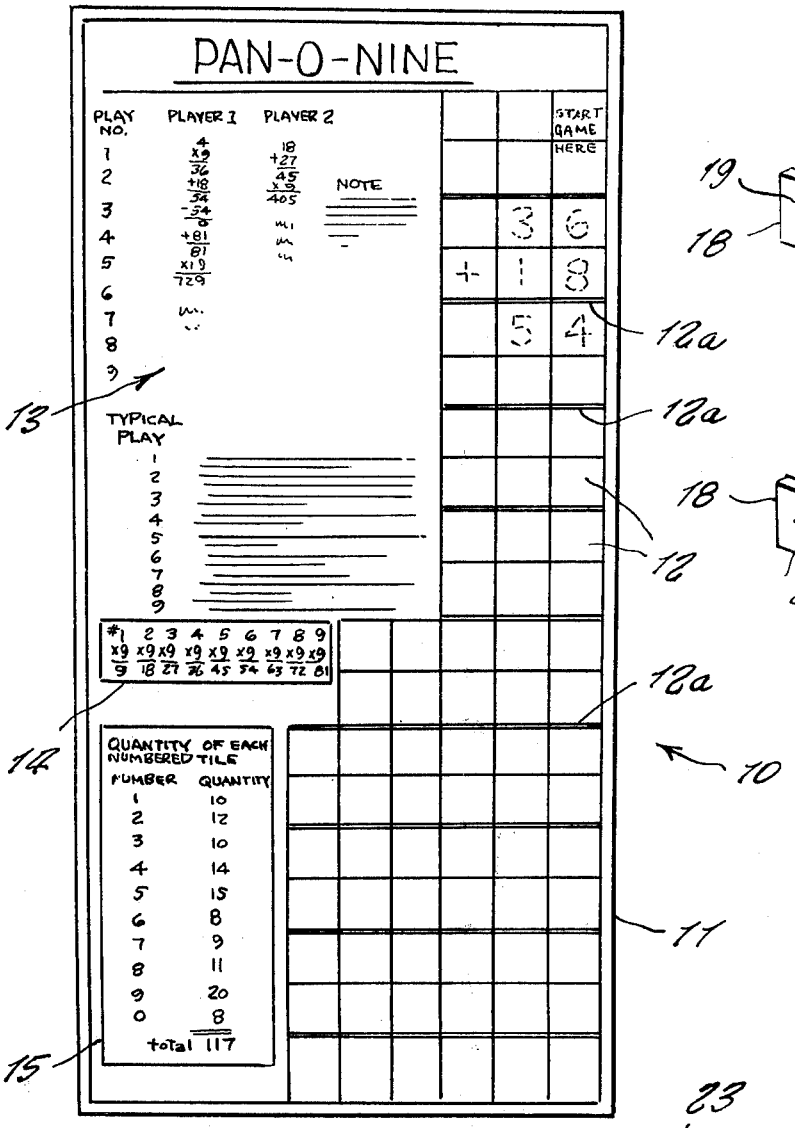
Fig. 3
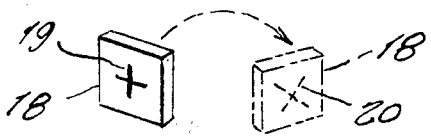
Fig. 4
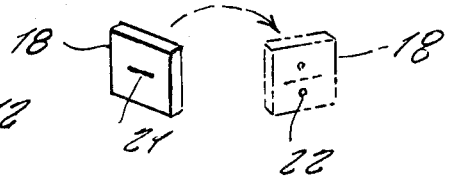
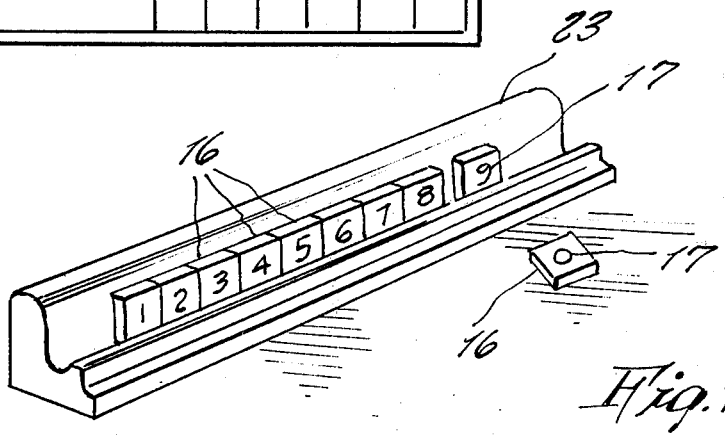
Fig. 2

ARITHMETIC BOARD GAME

This invention relates generally to arithmetic games.

A principal object of the present invention is to provide a Pan-O-Nine game of arithmetic which may be played by two players competitively for diversion and entertainment and which at the same time is educational.

Another object of the present invention is to provide a Pan-O-Nine game which can be modified to suit children in primary grades or which may be modified to suit accomplished mathmeticians.

Other objects are to provide a Pan-O-Nine game which is simple in design, inexpensive to manufacture, rugged in construction, easy to use and efficient in operation.

These and other objects will become readily evident upon a study of the following specification together with the accompanying drawing wherein:

FIG. 1 is a plan view of one of the playing boards;

FIG. 2 is a perspective view of one of the tile holding racks with a selection of numbered tiles placed thereupon;

FIG. 3 is a view of one of the mathematical symbol tiles;

FIG. 4 is a perspective view of another of the mathematical symbol tiles.

Referring now to the drawing in detail, the reference numeral 10 represents a Pan-O-Nine game, according to the present invention, wherein there is a pair of playing boards 11, one of which is illustrated in FIG. 1, the other being the same. The playing board is made upon a heavy card stock and is imprinted upon its front side with a plurality of square spaces 12 which are arranged so that there is a double line 12a between every two horizontal lines of spaces 12. Additionally upon the playing board there is imprinted an example 13 showing a typical progress of a game so to serve as an aid in guiding players. Additionally the front side of the playing board includes a multiplication table 14 and it also includes a table 15 that indicates the quantity of each numbered tile.

The present invention also includes 117 tiles each one of which is a same size as the squares or spaces 12 of the playing board. As shown in FIG. 2, some of the tiles 16 are provided with numerical digits 17 imprinted thereupon. The table 15 indicates how many of each of these tiles there are in the game. Thus for example the tile having the numerical digit 9 is indicated in the table 15 showing that there are 20 such tiles all bearing the same numerical digit.

Besides the above described 117 tiles 16 having numerical digits, the game also includes a plurality of multiplication symbol tiles 18, as shown in FIGS. 3 and 4. The tiles 18 shown in FIG. 3 are yellow in color and have a plus symbol 19 on one side and a multiplication symbol 20 upon its opposite side. The tile 18 shown in FIG. 4 is pink in color and has a subtraction symbol 21 upon one side and a division symbol 22 upon its opposite side.

Additionally the present game includes a rack 23 upon which the tiles may be placed during a game so that they face a player holding the tiles and preventing an opponent player to see the same. The holder accordingly maintains the tiles in an upright position so that they face only the player to whom they belong.

While the present invention includes rules for playing the game, such rules will be only briefly here indicated as such rules are not subject for a patent protection while the physical elements thereof such as the playing board and tiles are subject for patent protection. Accordingly the rules for playing the game will be only briefly here reviewed herebelow as follows:

The object of the game is to accumulate the highest game total and also to earn a total of nine points to win the game. Each player competes for high score by using the numbers in his rack to the best application of arithmetic to obtain the highest points for each play. Each player should have a acratch pad, a pencil for calculations of various combinations, and also those of his opponents.

To begin, the colored tiles are first arranged into two separate piles. The yellow tiles are thus separated from the pink tiles. Next all the numbered tiles 16 are placed flat upon the table with the numerical digits facing downward. These tiles are then mixed well. Each player selects one tile to determine who will play first. The player drawing the highest number of one through nine plays first. Each player then selects nine tiles and places them on his rack.

The first player selects from his rack those numbers and answeres that result from his ability to either multiply and single digit, by nine or add together any two of the numbers shown on the bottom line of the table 14, and if the first player can find the proper numbered tiles in his rack for the multiplication or addition, he places the tiles on the board 11 where there is imprinted the phrase "Start Game Here." He uses the appropriate arithmetic symbol on the colored tiles so that his tiles appear such as the example illustrated by the dotted lines in FIG. 1. If the first player cannot start the game due to lack of certain tile numbers on his rack, he must pass and discard one tile, placing it face down on the table and replace it with another from the table. The play is then passed to the second player. The second player follows the same steps as the first player and is given an opportunity to do.

Points are awarded each player as he shows a total on his board or changes his game total, so that of his opponent may do likewise. Points are equal to the number of times that the numerical digit 9 is contained in the new game total on the board when added across. Scores can be kept by one or each player. The players are now ready to start the second round of play.

Thus there is provided a Pan-O-Nine game for being played competitively between players.

While various changes may be made in the detailed construction, it is understood that such changes will be within the spirit and scope of the present invention as is defined by the appended claims.

What I claim is:

1. In an arithmetic board game, the combination of a pair of playing boards, and a plurality of one hundred and seventeen tiles of numerical value for being placed upon said playing boards, and said game additionally including a plurality of multiplication, division, addition and subtraction symbol tiles for use together with said numerical digit tiles, each of said playing boards comprising a flat panel having a plurality of square spaces imprinted thereupon, said spaces each being of a same size as said tiles, and said spaces being arranged in horizontal and vertical rows, a double line between each two said horizontal rows of said spaces, said playing board additionally including an example of playing the game for serving as a guide to players, said playing board additionally including a multiplication table imprinted thereupon and also a table indicating a quantity of each numbered tiles, said arithmetic symbol tiles comprising a plurality of yellow tiles having a plus sign on one side and a multiplication sign upon its other side while a remainder of said arithmetic symbol tiles are pink and have a subtraction sign on one side and a division sign upon its other side, and said game additionally including a rack of transverse L-shaped configuration for each player and upon which said tiles can be stored in an upright position hidden behind an upright wall of said rack so an opponent player is prevented from seeing said tiles.

* * * * *